US007464701B1

(12) United States Patent
Mendoza et al.

(10) Patent No.: US 7,464,701 B1
(45) Date of Patent: Dec. 16, 2008

(54) TOY GUN

(76) Inventors: Rigoberto Mendoza, 8700 Gregory Ave., Lamont, CA (US) 93241; Francicso Martinez, 8700 Gregory Ave., Lamont, CA (US) 93241

( * ) Notice: Subject to any disclaimer, the term of this patent is extended or adjusted under 35 U.S.C. 154(b) by 349 days.

(21) Appl. No.: 11/316,768

(22) Filed: Dec. 23, 2005

(51) Int. Cl.
*F41B 7/08* (2006.01)

(52) U.S. Cl. ..... 124/27; 124/20.1

(58) Field of Classification Search ..... 124/16, 124/17, 20.1, 20.2, 21, 26, 27
See application file for complete search history.

(56) References Cited

U.S. PATENT DOCUMENTS

| | | | | | |
|---|---|---|---|---|---|
| 107,442 | A | * | 9/1870 | Buckman | 124/21 |
| 1,571,643 | A | * | 2/1926 | Renick | 124/21 |
| 2,633,119 | A | * | 3/1953 | Bauderer et al. | 124/27 |
| 2,652,822 | A | * | 9/1953 | Griffith | 124/27 |
| 2,757,657 | A | | 8/1956 | Harris | |
| 3,572,311 | A | * | 3/1971 | Baer | 124/20.1 |
| 3,580,234 | A | | 5/1971 | Guyer, Jr. | |
| 4,125,106 | A | | 11/1978 | Kelly | |
| 4,256,077 | A | * | 3/1981 | Munson | 124/26 |
| 5,579,749 | A | * | 12/1996 | Wilkinson | 124/17 |
| 5,657,738 | A | | 8/1997 | Klundt | |
| D392,712 | S | | 3/1998 | Hammans | |

* cited by examiner

*Primary Examiner*—John Ricci
(74) *Attorney, Agent, or Firm*—Lawrence J. Gibney, Jr.

(57) ABSTRACT

This invention will be a toy gun and will provide entertainment value for a child by allowing an object to be propelled down the barrel of a structure that takes the appearance of a gun. Different gun designs will be provided to satisfy the individual tastes of the consumer such as having a single barrel or a double barrel. Various objects may be loaded and then "fired" by stretching the firing mechanism on the end of the structure.

5 Claims, 4 Drawing Sheets

TOY GUN

BACKGROUND OF THE INVENTION

A. Field of the Invention

This relates to entertainment using a toy gun and specifically a toy gun that emits a projectile.

B. Prior Art

There are many other prior art references related to toy guns, specifically for entertainment purposes. A representative example of this is Guyer, U.S. Pat. No. 3,580,234. Guyer, however, is a single-shot toy gun with a stretchable diaphragm. It does not have a reloadable ammunition clip, nor does it have the many features depicted in this particular device.

BRIEF SUMMARY OF THE INVENTION

This is a toy gun. It will have the appearance of a gun but is likely to be made out of a variety of materials that are commonly used with toys. Plastic is probably an excellent choice. The device will have a handle that the child will grip, a barrel, several sights as well as a device to force the projectile through the barrel towards a target.

The projective or ammunition can be stored in a removable chamber or clip, which is stored within the handle. The ammunition can be bean or a rock and is loaded through a loading chamber and into the firing mechanism, which is likely to be a balloon or similar elastic material. After the ammunition is loaded the gun is tilted to load the ammunition into the firing mechanism, which is stretched by the child. When the child releases the stretched balloon, it will force the projectile through the barrel and out of the device.

It is an object of this device to have entertainment value related to toy guns. It is a further object to have many different designs for this particular device, including a hand gun, a double-barrel shotgun as well as a device to project a water balloon or confetti.

DETAILED DESCRIPTION OF THE EMBODIMENTS

Figure 1:
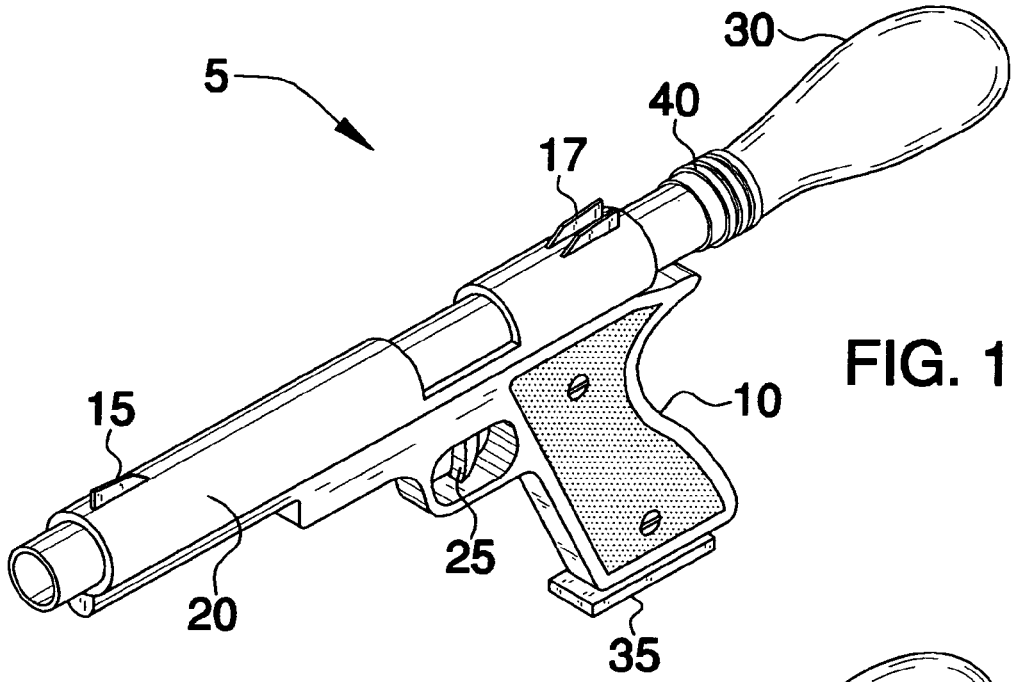
FIG. 1 is an isometric view of the embodiment showing a hand gun.
Figure 2:
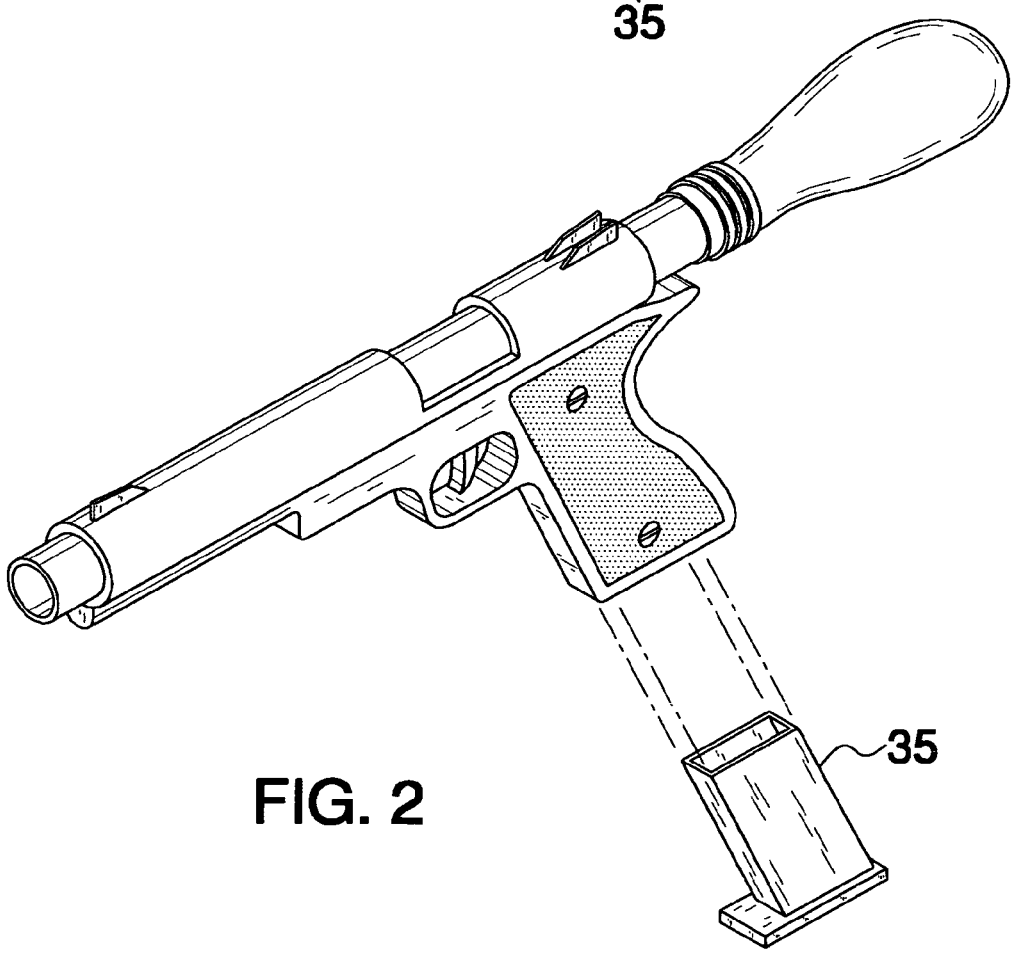
FIG. 2 is an isometric view showing the ammunition clip removed.
Figure 3:
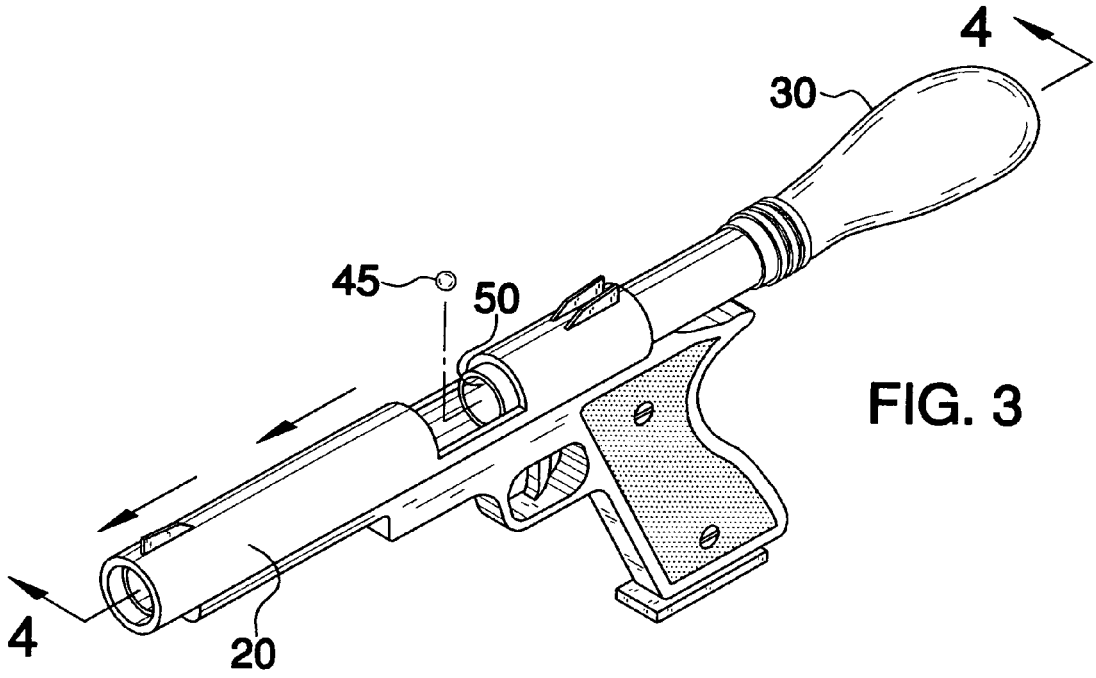
FIG. 3 is an isometric view of the projectile being loaded.
Figure 4:
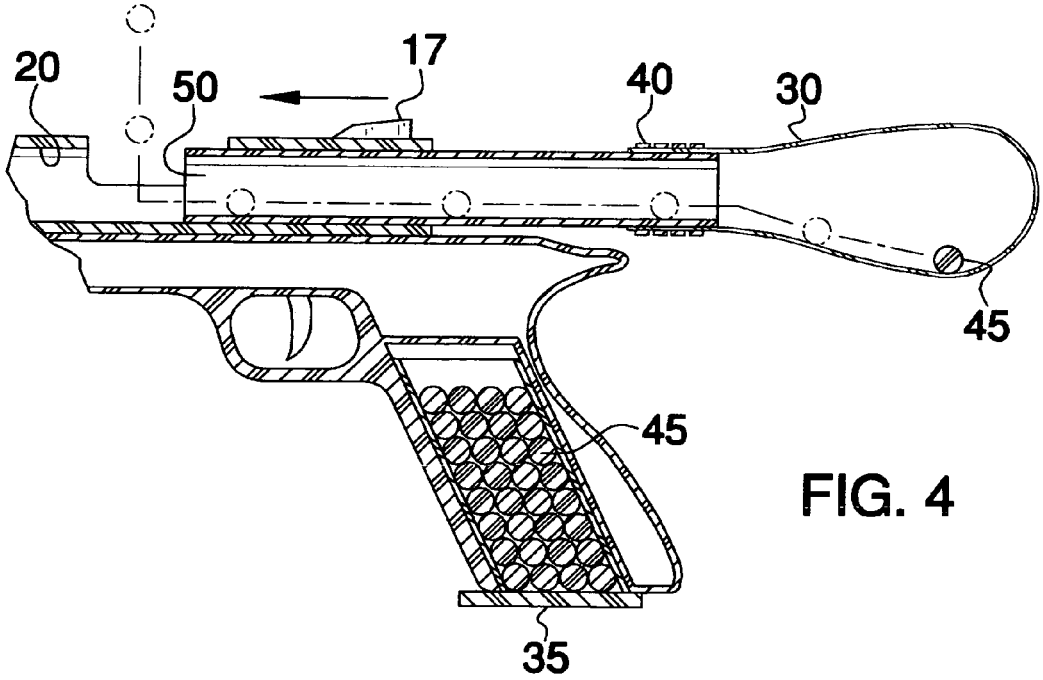
FIG. 4 is a cross-sectional view of the device according to the line 4-4 on FIG. 3.

This device 5 will have the appearance of a gun; however, it will be a toy gun. It is designed to fit within the hand of a child by its handle.

It will be equipped with a handle 10, a trigger 25, a pair of rear sights 17, and a front sight 15. Additionally, because it will have the appearance of a gun, it will have a barrel 20 as well as a "chamber" 50, through which ammunition is loaded.

The opening of the chamber will be covered and uncovered by means of an insert that will slide within the hollow barrel as the projectile is loaded. When the projectile is to be fired the opening for the chamber should be covered or closed so that there is no danger of the projectile hitting the top surface of the barrel and traveling backwards towards the user.

On one end of the device will be the firing mechanism 30, which will likely be comprised of elastic material such as rubber or balloon material 30 at one end. The firing mechanism 30 is secured to the device at the end of the barrel with a plurality of rubber bands 40.

Additionally, it will have a removable ammunition clip 35, which is inserted into the handle 10 of the device 5. The ammunition clip 35 can be removed from one end of the handle 10 in order to store more ammunition 45. The ammunition 45 may consist of a variety of objects such as beans, rocks or other small projectile, which will fit through the barrel 20.

Figure 5:
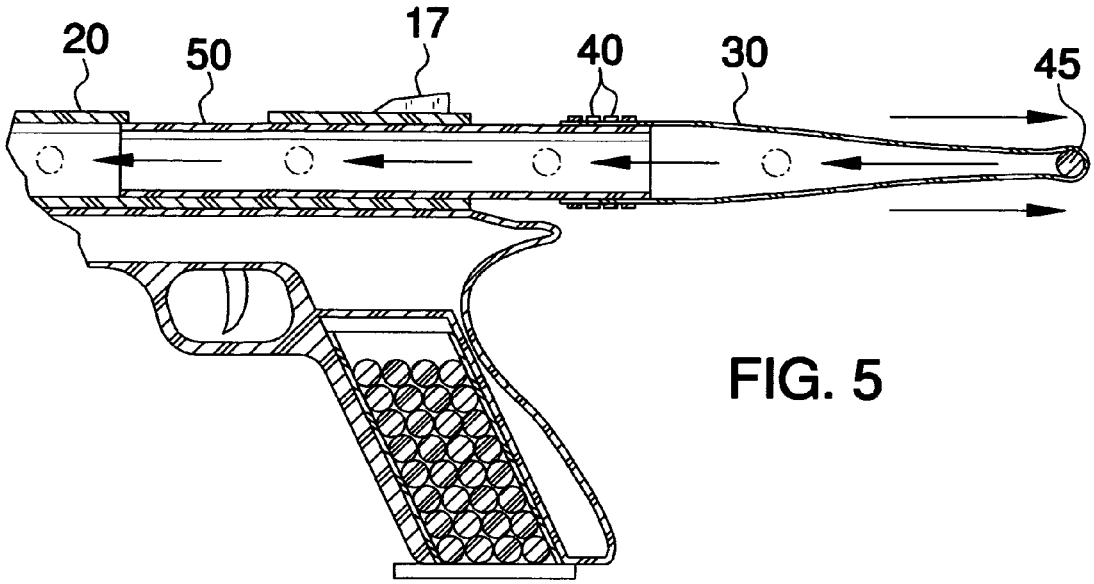
FIG. 5 is a depiction of the method by which the projectile is forced through the barrel.

The ammunition 45 is loaded by opening the loading chamber 15, which allows access to the interior of the barrel 20. The loading chamber is likely to be a small portion on top of the barrel that will slide a predetermined distance in which to load the ammunition into the barrel 20. The ammunition 45 is loaded and then placed into the balloon 30 at one end 30, probably by tilting the device 5. The person grabs the balloon 30 and stretches it as depicted in FIG. 5. The ammunition 45 is held by the user, as the balloon 30 is stretched. The ammunition 45 with the balloon 30 is then released, and the projectile is forced through the barrel 20 towards the target.

To give the appearance of a real gun, a set of rear sights 17 and a front sight 15 are placed on the barrel itself. This will give the added effect of a real gun. Additionally to give the appearance of a real gun a trigger 25 is placed on the device. The trigger 25 however does not control the emission of the ammunition 45 and is strictly added to give the appearance of a real gun.

Plastic is probably an excellent choice of material for this type of device.

Second Embodiment

Figure 6:
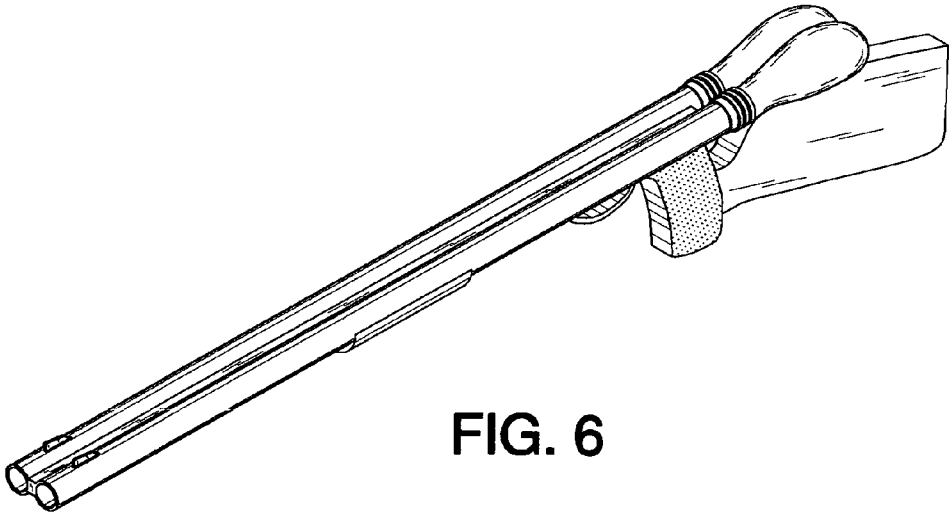
FIG. 6 is an isometric view of the second embodiment showing a double-barrel shotgun.

In order to provide a variety of shapes for the device, there will also be other embodiments, which will include a double-barrel shotgun model. FIG. 6 The operation of the device will be identical, although it will be two barrels instead of one and two balloons instead of one.

Third Embodiment

Figure 7:
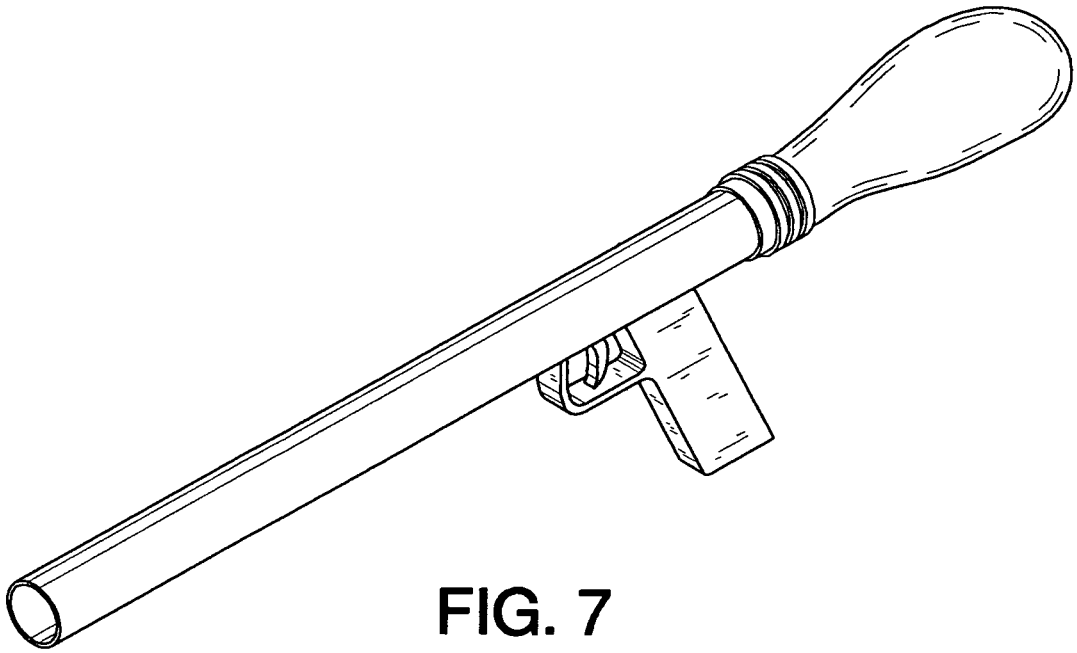
FIG. 7 is an isometric view of the device with a water balloon capability.

Additionally, a third embodiment will be a water balloon mechanism by which a water balloon is loaded into the balloon. The balloon is then stretched, and a water balloon is projected through the barrel such as depicted in FIG. 7.

Fourth Embodiment

Figure 8:
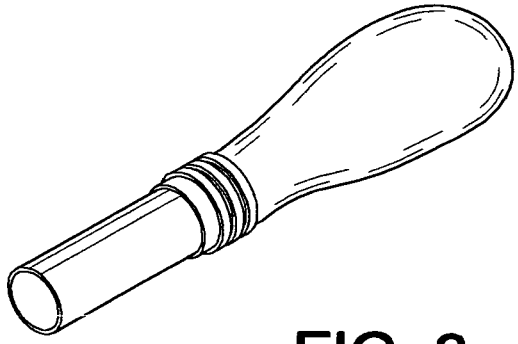
FIG. 8 is a fragmented view of the barrel showing a confetti embodiment.

Another embodiment may also allow the device to propel confetti through the barrel. The balloon for the confetti is larger but the barrel is much shorter; the balloon is secured in the same manner to the barrel such as depicted in FIG. 8.

While the embodiments of the invention have been disclosed, certain modifications may be made by those skilled in the art to modify the invention without departing from the spirit of the invention.

The inventors claim:

1. A toy gun, which is comprised of:

a. a handle;

wherein the handle is designed to fit within the grip of a child;

wherein a portion of the handle is hollow;

b. a trigger;

wherein the trigger is provided for cosmetic purposes;

c. an ammunition clip;

wherein the ammunition clip is removable;

wherein the ammunition clip provides a space to store ammunition;

wherein the ammunition clip is stowed in the hollow portion of the handle;

d. barrel;

wherein the barrel is of a predetermined length;

wherein the barrel is hollow;

wherein the barrel has a first end and a second end;

wherein a set of rear sights is provided on the first end of the barrel;

wherein a front sight is provided on the second end of the barrel;

e. an insert in the barrel;

wherein the insert is placed within the barrel;

wherein the insert uncovers and covers the opening for a loading chamber on the top of the barrel;

f. firing mechanism;

wherein the firing mechanism is secured to the first end of the barrel;

g. means to secure the firing mechanism;

wherein a plurality of rubber bands is used to secure the firing mechanism to the first end of the barrel;

h. loading chamber;

wherein a loading chamber is provided on the top of the barrel;

wherein the loading chamber provides access to the interior of the barrel.

2. The device as described in claim 1 wherein the ammunition is stored in the ammunition clip.

3. The device as described in claim 1 wherein two barrels are used.

4. The device as described in claim 1 wherein the firing mechanism is a water balloon.

5. The device as described in claim 1 wherein confetti may be discharged.

* * * * *